US005100152A

United States Patent [19]

Butler, III

[11] Patent Number: 5,100,152

[45] Date of Patent: Mar. 31, 1992

[54] TAG GAME

[76] Inventor: George H. Butler, III, 5551 E. Elmwood, Mesa, Ariz. 85205

[21] Appl. No.: 632,490

[22] Filed: Dec. 24, 1990

[51] Int. Cl.[5] ..... A63B 43/00; A63B 67/00

[52] U.S. Cl. ..... 273/346; 273/428; 273/58 K

[58] Field of Search ..... 273/346, 58 K

[56] References Cited

U.S. PATENT DOCUMENTS 3,032,345 5/1962 Lemelson ..... 273/346
4,017,076 4/1977 Bai ..... 273/346
4,235,042 11/1980 Hills ..... 273/414 X
4,718,677 1/1988 Barnes ..... 273/346 X
4,789,161 12/1988 Waskelo ..... 273/346 X
4,836,554 6/1989 Robbins ..... 273/346 X
4,919,436 4/1990 Buselli ..... 273/346
4,971,334 11/1990 Stewart ..... 273/346

*Primary Examiner*—William H. Grieb
*Attorney, Agent, or Firm*—Tod R. Nissle

[57] ABSTRACT

A tag game in which a projectile thrown by one person is intended to strike and adhere to an article of clothing worn by a second person.

4 Claims, 2 Drawing Sheets

TAG GAME

This invention relates to games.

More particularly, the invention relates to a tag game in which a projectile thrown by one person is intended to strike an adhere to an article of clothing worn by a second person.

In a further respect, the invention relates to a tag game of the type described in which the projectile can strike the second person without causing injury, the projectile producing a high aerodynamic drag force and being constructed to prevent injury to the eyes or face of the second person.

In another respect, the invention relates to a tag game of the type described in which projectiles of different shape and dimension are utilized to effect a change in the degree of difficulty of the game.

A variety of toss and catch games are known in the art. See, for example, U.S. Pat. Nos. 4,919,436 to Buselli and 4,789,161 to Waskelo. Such toss and catch games, in addition to providing recreation, enable an individual to practice an improve handeye coordination. None of the prior art games, however, provide the challenge of throwing a projectile to contact a moving target which can quickly move laterally or vertically, i.e., the prior art games do not involve throwing a projectile at and striking a moving person. Throwing a projectile directly at and striking a person runs contrary to accepted practice because most projectiles will cause injury on striking a person, particularly if the projectile strikes a person in the face. For example, the dangers posed by a baseball are well documented. Even a whiffleball can cause discomfort on striking the face because the edges which bound and define openings in the whiffleball can dig into and form a temporary imprint or line of irritation on the face of an individual. On the other hand, throwing at a moving human target is something most individuals, especially children, inherently enjoy.

Accordingly, it would be highly desirable to provide a game which allowed one individual to throw a projectile at another individual and which greatly minimized the likelihood that the projectile would cause injury to the individuals participating in the game.

Therefore, it is a principal object of the invention to provide an improved game which enables one person to "tag" a second person by throwing a projectile at and striking a second person.

It is a further object of the invention to provide an improved tag game of the type described in which the projectile is constructed to greatly minimize the likelihood of serious injury to participants of the game.

Another object of the invention is to provide an improved tag game of the type described in which edges of the projectile can usually, without causing injury, contact the closed eye of an individual participating in the game.

These and other, further and more specific objects and advantages of the invention will be apparent to those skilled in the art from the following detailed description thereof, taken in conjunction with the drawings, in which.

Briefly, in accordance with my invention, I provide an improved tag game. The game includes apparatus comprising clothing worn on the person and having an outer surface comprised at least in part of burr material; a projectile for throwing at the clothing from a distance and formed from a soft, resilient material and having a leading portion and a trailing portion as the projectile moves through the air. The leading and trailing portions co-terminate at an edge. The projectile is shaped and dimensioned such that if the surface of the projectile were smooth, the projectile while moving through the air would cause air flowing past the projectile to break away from the projectile to produce eddies in the air behind the trailing portion to produce form drag. A pile material covers at least a portion of the projectile other than the edge such that if the edge contacts the eye of a person, the soft resilient material contacts the eye and compresses to minimize injury to the eye of the person. The pile material is effective to adhere to the burr material when the pile material and the burr material come into contact.

Figure 1:
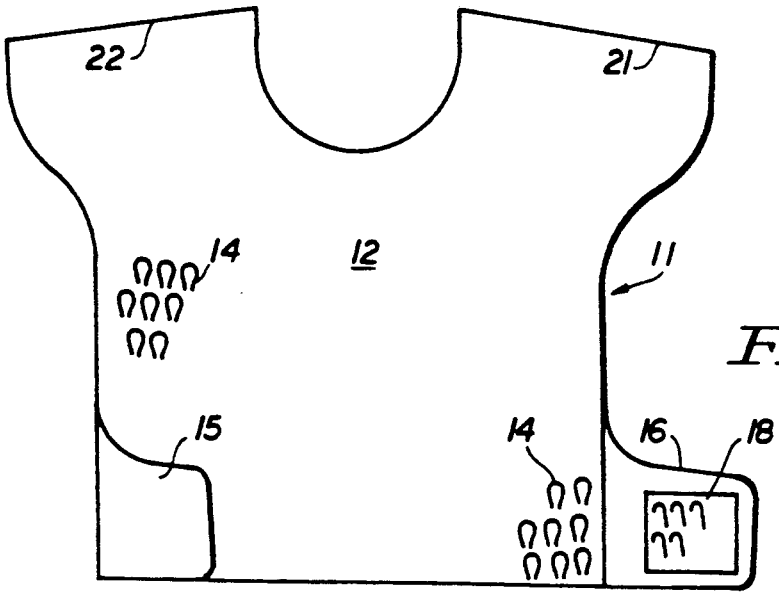
FIG. 1 is a front view illustrating a vest utilized in the practice of the game of the invention.
Figure 2:
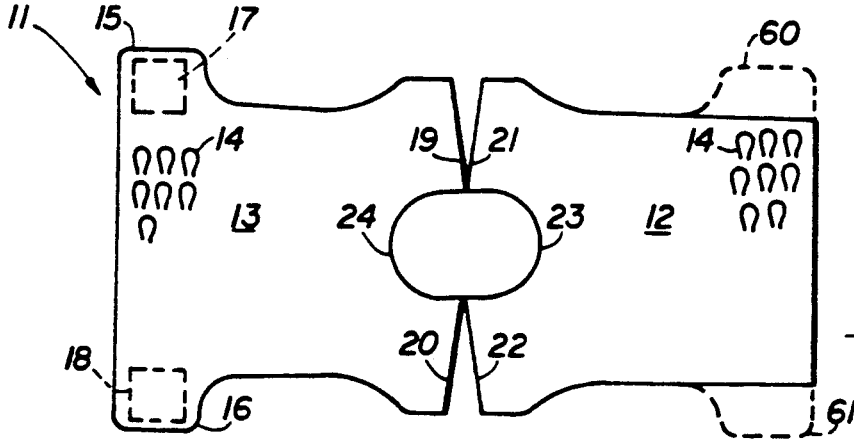
FIG. 2 is a top assembly view illustrating the vest of FIG. 1.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 is a front view of a vest worn on the person and generally indicated by reference character 11. Vest 11 includes a front portion 12 and a rear portion 13. The outer surface of front portion 12 and of rear portion 13 is covered with a loop or pile Velcro® material 14. The outer surfaces of portions 12 and 13 face outwardly away from the torso of the individual wearing the vest. The inner surfaces (not visible) of portions 12 and 13 face and contact the body or clothing on the torso of the individual wearing the vest 11. Rear portion 13 includes flaps 15 and 16. The inner surface of each flap 15 and 16 is provided with a burr or hook patch 17, 18 respectively, of Velcro® or other similar material which will releasably adhere to the loop or similar material 14 found on the outer surfaces of portions 12 and 13 of vest 11. As shown in FIG. 1, when the vest 11 is worn on the person, flaps 15, 16 wrap around the waist of the person so that hook patches 17 and 18 releasably contact and adhere to the loop material 14 on the outer surface of the front portion 12 of vest 11. Front portion 12 covers the chest and stomach of the person while rear portion 13 covers the back of the person.

The upper edges 19 and 21 of portions 13 and 12, respectively, can be fixedly sewn together or can be releasably attached to one another with Velcro® or other similar materials. Attaching edges 19 and 21 with Velcro® is preferred because when an individual is wearing vest 11 and the neck 23 or 24 of the vest is grabbed and pulled by another person, edges 19 and 21 will separate, preventing injury to the neck of the person wearing the vest 11. The upper edges 20 and 22 of portions 13 and 12, respectively, can similarly be fixedly sewn together or can be releasably attached to one another with Velcro ® or other similar releasable materials.

Figure 3:
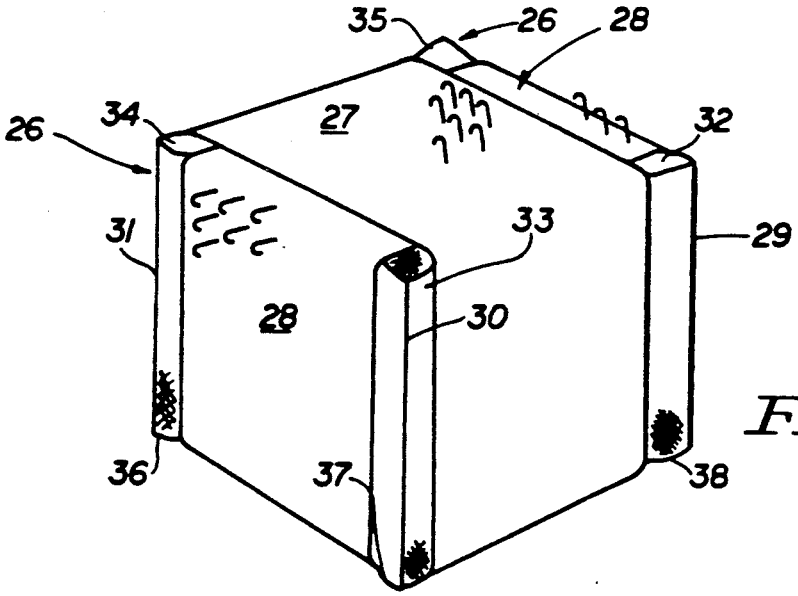
FIG. 3 is a perspective view illustrating a projectile used in the practice of the invention.

The handheld and handthrown projectile in FIG. 3 includes a soft resilient 2.5 inch high urethane foam cube 26 circumscribed by a pair 27, 28 of Velcro ® hook or burr strips. Strips 27, 28 tightly circumscribe and compress the portions of cube 26 covered by strips 27 and 28 such that edges 29 to 31 and corners 32 to 38 extend resiliently upwardly and outwardly from the elongate side edges of strips 27 and 28. The projectile of FIG. 3 is held and thrown by a person toward the vest 11 worn by another person, the object being to contact the hook material wrapped around cube 26 with the loop material 14 on vest 11 so that the projectile of FIG. 3 adheres to vest 11. The person wearing the vest can be stationary or can be moving laterally or vertically.

Figure 4:
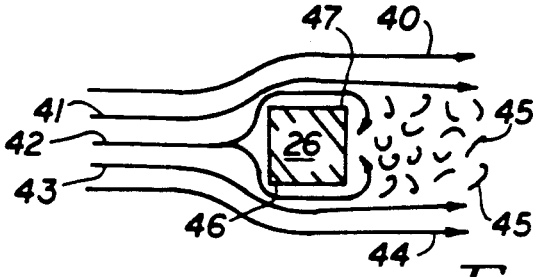
FIG. 4 is a side elevation view illustrating the form drag produced by a projectile which is not streamlined or aerodynamically clean.
Figure 5:
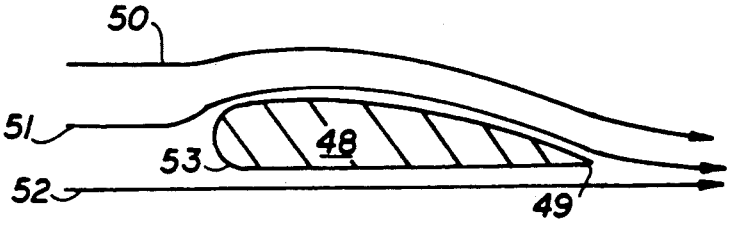
FIG. 5 is a side elevation view illustrating the lack of form drag produced by a projectile which is streamlined and aerodynamically clean; and, FIG. 6 is a side view illustrating an alternate embodiment of a projectile which is used in the practice of the invention.

While the game of the invention can be played by individuals of any age, it is specifically intended for children. In this respect, the projectile of FIG. 3 has a construction which minimizes the likelihood of injury when the projectile contacts an individual. The projectile is formed to produce high aerodynamic drag as it travels through the air. FIG. 4 illustrates the high aerodynamic drag produced by a cube 26 moving through the air. Arrows 40 to 44 represent the flow of air around the cube 26. The air flows around the leading portion 46 of cube 26. Eddies or turbulent air flow 45 occurs behind the trailing portion 47 of cube 26. In contrast to cube 26, the airfoil 48 of FIG. 5 is streamlined and aerodynamically clean and does not exhibit the information of eddies behind the trailing edge 49 of airfoil 48. Arrows 50 to 52 represents the flow of air over leading portion 53 and over the remainder of airfoil 48. In the practice of the invention, it is important that the projectile used generate high turbulence and eddies 45 behind the trailing portion of the projectile as the projectile moves through the air. The generation of eddies and turblence is termed form drag. A projectile with a high form drag slows more quickly as it moves through the air, particularly if the projectile is fabricated out of a lightweight material such as soft, readily compressed, resilient polyurethane foam. The formation of form drag is facilitated when the leading portion of a projectile if flat (as in FIG. 4) instead of being curved (as in FIG. 5). Further, the formation of form drag is facilitated when air flows around edges, as in FIG. 4. In FIG. 5, the trailing edge of airfoil 48 represents an edge, but, as indicated by arrows 50 to 52, air simply flows by and not around edge 49. In contrast, in FIG. 4 air flows around the edges of cube 29. The flow of air around the edges of cube 26 on the trailing portion of the cube significantly contributes to the formation of eddies 45, as do the flat surfaces of cube 26.

Another important feature of the projectile of FIG. 3 is that the strips 27 and 28 compress the portions of cube 26 which are beneath strips 27 and 28 such that the portions of cube 26 which are not covered by strips 27 and 28 extend upwardly and outwardly away from the side edges of the strips 27 and 28. The edges 29 to 31 and corners 32 to 38 are intentionally not covered by strips 27 and 28, and are left exposed so that if, for example, a corner 33 contacts the face or eye of a person the soft, resilient material of cube 26 compresses and absorbs the force of contact of the cube against the eye, avoiding or minimizing any injury done to the eye. The strips 27, while pliable, are relatively hard. If a corner 32 to 38 of a projectile contacts the face, it is preferred that the corner not be comprised of overlapping Velcro ® strips 27 and 28. It is presently also preferred that strips 27, 28 contain loops or pile instead of the hooks shown in FIG. 3, and that vest 11 be provided with hooks, instead of the loops 14 shown in FIG. 1. When pile or hook Velcro ® is utilized on strips 27 and 28, the pile material tends to be less abrasive to the skin and eyes than the hook material.

Figure 6:
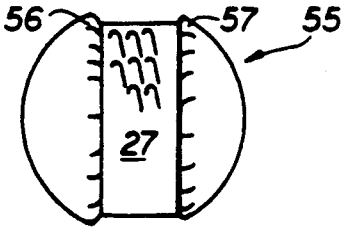

The compressive effect of Velcro ® strip 27 is further illustrated in FIG. 6, where strip 27 circumscribes and compresses a soft spherical foam projectile 55 such that circular edges 56 and 57 extend upwardly and outwardly from strip 27. When edges 56 and 57 extend upwardly and outwardly from strip 27, the edges 56 and 57 tend to contact a person's body before strip 27, in the same manner that the raised portions or nipples on a shower mat tend to contact the bottom of a person's foot before the foot contacts the portion of the shower matt from which the nipple upwardly depend.

The projectile used in the invention can be square, round or take on any shape or dimension which produces form drag and which enables strips of Velcro ® or other releasably adhering material to circumcribe and compress the projectile to produce raised portions of resilient material which extend upwardly and outwardly away from the Velcro ® strips.

Projectiles can be provided which make it more difficult for a person to throw the projectile against and adhere the projectile to a vest 11. For example, if in FIG. 3 strip 27 is removed from foam cube 26 and only strip 28 circumscribes cube 26, then two of the six faces of cube 26 are not covered by a Velcro ® strip. If either of the two faces of the cube which are not covered by Velcro ® contacts vest 11, the projectile of FIG. 3 will not adhere to the vest 11. Consequently, removing strip 27 from cube 26 makes it more difficult to successfully throw and adhere the projectile of FIG. 3 to vest 11. Altering the amount of the outer surface area of cube 26 covered by Velcro ® is therefore a way of increasing or decreasing the difficulty of successfully throwing and adhering the projectile of FIG. 3 to vest 11. The spherical projectile of FIG. 6 has a larger proportion of its outer surface which is not covered by Velcro ® than does the cube 26 in FIG. 3. Throwing and adhering the projectile of FIG. 6 to vest 11 is more difficult than throwing and adhering the projectile of FIG. 3 to vest 11.

Altering the shape and dimension of the projectile can affect the difficulty of successfully throwing and adhering the projectile to vest 11. A projectile in the shape of a hexahedron, a dodecahedron or an icosahedron would include more edges intermediate the planar faces of the polyhedron and would include smaller faces than a cube or pyramid shaped projectile. Covering only half, or fewer, of the faces of a dodecahedron or icosahedron or other polyhedron would tend to further decrease the likelihood that the dodecahedron or icosahedron would adhere to vest 11 on being thrown thereagainst. Projectiles having a polyhedron shape are desirable in the practice of the invention because they tend to produce more aerodynamic drag than round objects. The velocity of a projectile having a high aerodynamic drag rapidly decreases as the projectile moves through the air, reducing the likelihood that injury will occur when the projectile strikes a person.

In addition to the vest and projectile shown in FIGS. 1 and 3, persons playing the game of the invention can utilize a shield, stick or other protective device which is attached to the arm or carried in the hand of a person. The shield or stick can be covered with a hook pile material 14 to "catch" projectiles which contact the shield. Alternatively, the shield can not be covered with a pile material 14 but can be smooth or otherwise be formed so that projectiles which contact the shield or stick do not adhere to the shield or stick.

In use, two or more persons each don a vest 11 and are provided with one or more projectiles. The projectiles can be identical to those shown in FIGS. 3 and 6 or can be otherwise shaped, dimensioned and constructed in accordance with the principles of the invention. Each person throws his projectile at the other in an attempt to cause the projectile to strike and adhere to the vest 11 worn by the other person. The first person to cause his projectile to adhere to the vest of the other person is declared the winner of the game. If desired, each individual can utilize a shield or other protective device to deflect or catch projectiles which are thrown toward his person. As would be appreciated by those of skill in the art, a great many games and game rules can be improvised utilizing the apparatus of the invention. However, each game would include as a principal purpose throwing a projectile at the vest of another to contact and adhere to the vest.

If desired, vest 11 can include flaps 60, 61 covered with loop material 14. Flaps 60, 61 would extend around the sides of the individual wearing vest 11 and would be overlaid by flaps 15, 16 respectively. The hook patch 17, 18 would contact the loop material 14 on flaps 60 and 61.

Foam cube 26 is shaped and dimensioned and has a softness and/or compressability such that if an individual falls on the projectile and the projectile is compressed between the body of the individual and the ground, the projectile readily compresses and does not puncture, bruise, or injure the body of the individual. Similarly, strips 27 and 28 have appropriate softness, compressiblility, and/or pliability to give, alter shape, or be compressed along the cube 26. Any projectile utilized in the practice of the invention is shaped and dimensioned and has a softness, compressibility, and/or pliability such that if an individual falls on the projectile and the projectile is compressed between the body of the individual and the ground, the projectile readily compresses, deforms, or alters shape such that the projectile does not puncture, bruise, or injure the body of the individual. The edges of cube 26 are not rigid, but are readily deformed and compressed. The edges of strips 27, 28 are pliable and are readily deformed.

Having described my invention in such terms as to enable those skilled in the art to understand and practise it, and having identified the presently preferred embodiments thereof, I claim:

1. A tag game comprising apparatus, in combination (a) clothing worn on the person and having an outer surface comprised at least in part of one of the pair of materials comprising burr material and pile material;

(b) a projectile for throwing at said clothing from a distance and formed from a soft, resilient core material and having (i) a leading portion as said projectile moves through the air, (ii) a trailing portion as said projectile moves through the air, and (iii) a plurality of surfaces each co-terminating at an edge with another of said surfaces, said projectile being shaped and dimensioned such that if the surfaces of said projectile were smooth, said projectile while moving through the air would cause air flowing past said edge to break away from said projectile to produce eddies in the air behind said trailing portion to produce form drag; and, (c) at least one strip of cover material (i) comprised of the other of said pair of materials comprising burr material and pile material, (ii) circumscribing, compressing and covering a portion of said projectile, and (iii) spaced apart from said edge, such that said edge of said soft, resilient core material spaced apart from said strip is raised with respect to said strip and extends outwardly away from said strip and said compressed portion of said projectile, and said raised edge reduces the likelihood that said strip will contact the eye of a user;

said pile material effective to adhere to said burr material when said pile material and said burr material come into contact.

2. A tag game comprising apparatus, in combination (a) clothing worn on the person and having an outer surface comprised at least in part of one of the pair of material comprising burr material and pile material;

(b) first and second hand-held and hand-hurled projectiles for throwing at said clothing from a distance, said projectiles each formed from a soft resilient core material and having (i) an outer surface area, (ii) a selected shape and dimension, (iii) a leading portion as said projectile moves through the air, (iv) a trailing portion as said projectile moves through the air, and (v) a plurality of edges, said projectiles being shaped and dimensioned such that said projectiles while moving through the air cause air flowing past the projectiles to break away from said projectiles to produce eddies behind said trailing portion to produce form drag; and, (c) strips of cover material comprised of the other of said pair of materials comprising burr material and pile material, each of said strips of material circumscribing, compressing and covering a selected amount of said surface area of one of said first projectile and said second projectile, said pile material effective to adhere to said burr material when said pile material and said burr material come into contact, said shape and dimension of said first projectile being different than said shape and dimension of said second projectile, the number of edges on said first projectile being different than the number of edges on said second projectile.

3. A tag game comprising, in combination, (a) a vest-type garment worn on the person and including (i) bonding material, and, (ii) front and rear panels;

(b) means for releasably securing said panels to one another at the shoulders of a user such that when one of said panels is grabbed and pulled at the shoulders of the user, said panels will separate at the shoulders of the user to reduce the risk of neck injury to the user;

(c) a projectile for throwing at said garment from a distance and formed from a soft, resilient core material and having (i) a leading portion as said projectile moves through the air, and (ii) a trailing portion as said projectile moves through the air, said leading and trailing portions co-terminating at a first edge, said projectile being shaped and dimensioned such that if the surface of the projectile were smooth, said projectile while moving through the air would cause air flowing past the projectile to break away from said projectile to produce eddies in the air behind said trailing portion to produce form drag; and, (d) a cover of releasable bonding material covering at least a portion of said projectile other than said edge such that if said edge contacts the eye of a person, said soft resilient core material in said edge contacts the eye and compresses to minimize injury to the eye of the person.

4. The tag game of claim 3 wherein (a) said projectile includes (i) a second edge spaced apart from said first edge, and (ii) a plurality of contiguous flat surfaces each co-terminating at one of said edges with another of said flat surfaces, one of said flat surfaces extending intermediate said first and second edges;

(b) said releasable bonding material comrpises at least one strip which (i) circumscribes, compresses and covers a portion of said projectile, (ii) covers and compresses a portion of said one of said flat surfaces intermediate said first and second edges, and (iii) is spaced apart from said edges such that said edges are raised with respect to said strip and extend outwardly away from a plane passing through and generally parallel to said compressed portion of said one of said flat surfaces intermediate said first and second edges.

* * * * *